US005101564A

United States Patent [19]

Melter

[11] Patent Number: 5,101,564

[45] Date of Patent: Apr. 7, 1992

[54] HAND-HELD CUTTER HAVING A ROTATABLE CIRCULAR BLADE AND SAFETY GUARD

[75] Inventor: Craig H. Melter, Baraboo, Wis.

[73] Assignee: Fiskars Oy AB, Helsinki, Finland

[21] Appl. No.: 731,497

[22] Filed: Jul. 17, 1991

[51] Int. Cl.[5] ..... B26B 3/00

[52] U.S. Cl. ..... 30/319; 30/292; 30/307

[58] Field of Search ..... 30/319, 307, 162, 292, 30/299

[56] References Cited

U.S. PATENT DOCUMENTS

| | | | |
|---|---|---|---|
| 1,306,783 | 6/1919 | Smolinsky | 30/299 |
| 2,568,353 | 9/1951 | Miseta, Jr. | 30/299 |
| 3,802,080 | 4/1974 | Peter | 30/292 |
| 4,020,550 | 5/1977 | Okada | 30/292 |
| 4,301,594 | 11/1981 | Okada | 30/292 |
| 4,432,137 | 2/1984 | Okada | 30/292 |
| 4,601,103 | 7/1986 | Sugiyama | 30/319 |
| 4,809,437 | 3/1989 | Saliaris | 30/307 |

*Primary Examiner*—Douglas D. Watts
*Assistant Examiner*—Hwei-Siu Payer
*Attorney, Agent, or Firm*—Foley & Lardner

[57] ABSTRACT

A rotary cutter having a handle, a cylindrical head formed on one end of the handle and having an internal cavity with a planar surface on each side, an actuating member is pivotally mounted in the cavity with a circular blade secured to one side of the actuating member in a parallel relation to one of the planar surfaces, a pivoting member is provided on the periphery of the head for moving the actuating member to an operative position with a portion of the blade projecting outwardly from the cylindrical head, the actuating member being biased to a storage position within the cylindrical member.

10 Claims, 4 Drawing Sheets

HAND-HELD CUTTER HAVING A ROTATABLE CIRCULAR BLADE AND SAFETY GUARD

FIELD OF THE INVENTION

The present invention relates generally to hand-held tools and, more particularly, to hand-held cutters of the type including a rotatable circular blade.

BACKGROUND OF THE INVENTION

In general, hand-held rotary cutters are well known. Such cutters are of particular utility for cutting sheet material such as cloth and wallpaper, and typically comprise an elongate handle with a circular cutting blade rotatably fastened to one end. The user grasps the handle and rolls the circular cutting blade along the object to be cut, placing downward and forward pressure on the cutting wheel. Examples of such rotary cutters are disclosed in U.S. Pat. No. 278,103, issued May 22, 1883, to A. Curtis; U.S. Pat. No. 630,094, issued Aug. 1, 1899, to W. Noble; U.S. Pat. No. 306,783, issued June 17, 1919, to T. Smolinsky; U.S. Pat. No. 2,568,353, issued Sept. 18, 1951, to F. Misetta, Jr.; U.S. Pat. No. 2,677,180, issued May 4, 1954, to F. Schierghofer; U.S. Pat. No. 4,020,550, issued May 3, 1977, to Y. Okada; and U.S. Pat. No. 4,301,594, issued Nov. 24, 1981, to Y. Okada; U.S. Pat. No. 4,601,103, issued July 22, 1986, to M. Sugiyama; and U.S. Pat. No. 4,809,437, issued Mar. 7, 1989, to G. Saliaris.

Guard mechanisms to cover or otherwise limit access to the blade when the cutter is not in use are also well known. Examples of such guard mechanisms are described in the above-noted U.S. Pat. No. 1,306,783, issued June 17, 1919, to T. Smolinsky; U.S. Pat. No. 4,301,594, issued Nov. 24, 1981, to Y. Okada; and U.S. Pat. No. 4,601,103, issued July 22, 1986, to M. Sugiyama.

The prior art hand-held rotary cutters tend to be disadvantageous in a number of respects: they tend to be uncomfortable, and difficult to guide accurately, when exerting sufficient downward and forward force to effect cutting. In addition, it is desirable that the guard mechanism employed permit the blade to easily be exposed and retracted using one hand, and that the cutter be equally capable of use with either a right or left hand.

SUMMARY OF THE PRESENT INVENTION

The present invention provides a particularly advantageous hand-held rotary cutter. In accordance with one aspect of the invention, a contoured handle is provided that permits the cutter to be accurately guided by either hand while exerting downward pressure.

In accordance with another aspect of the present invention, the cutter body includes a generally circular head of a diameter greater than that of the blade. When in use, a portion of the periphery of the blade is exposed, extending beyond the periphery of the head. When not in use, the blade is retracted into a guarded position with the blade periphery contained within the area of the head. Preferably, the blade is moved along an arcuate path relative to the handle to selectively expose, and retract the cutting perimeter of the blade.

The rotary cutter is advantageously provided with a pivotal member within the head of the handle which supports the blade and is biased to a guarded position.

One of the principal features of the invention is the provision of a mechanical stop which is positioned to engage and hold the cutter blade in an operative position to thereby relieve pressure on the user's hand.

A further feature of the present invention is the ability to quickly and easily disassemble the blade from the handle for cleaning of all component parts of the rotary cutter.

Other principal features and advantages of the invention will become apparent to those skilled in the art upon review of the following drawings, the detailed description and the appended claims.

BRIEF DESCRIPTION OF THE DRAWING

A preferred exemplary embodiment of the present invention will be described in conjunction with the appended drawing, wherein like numerals denote like elements, and.

Figure 2:
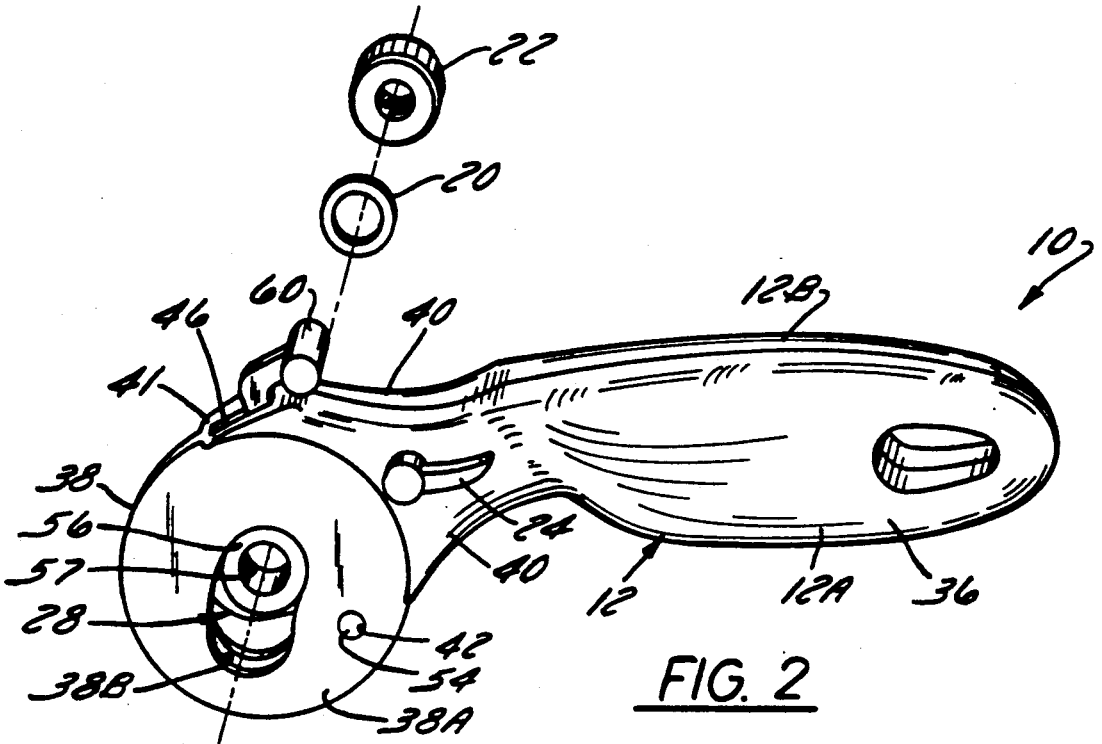
FIG. 2 is an exploded view of the cutter assembly of the rotary cutter of FIG. 1.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Figure 1:
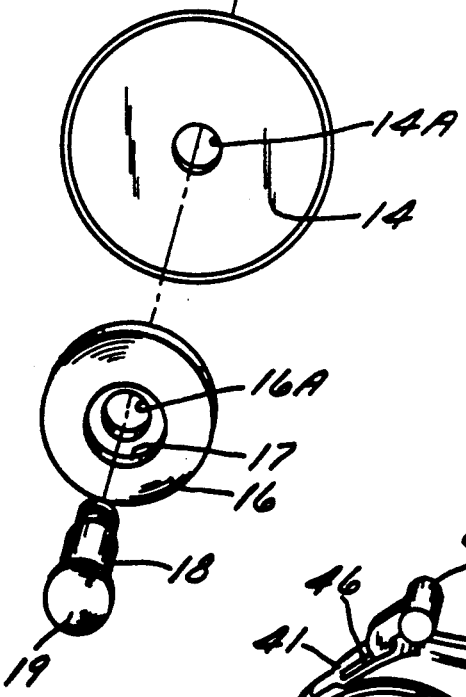
FIG. 1 is a perspective view of a hand-held rotary cutter in accordance with the present invention.
Figure 1:
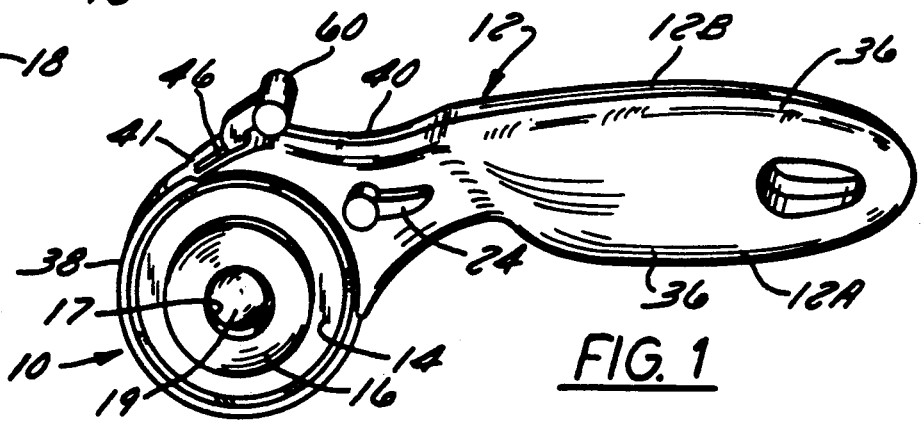
Figure 3:
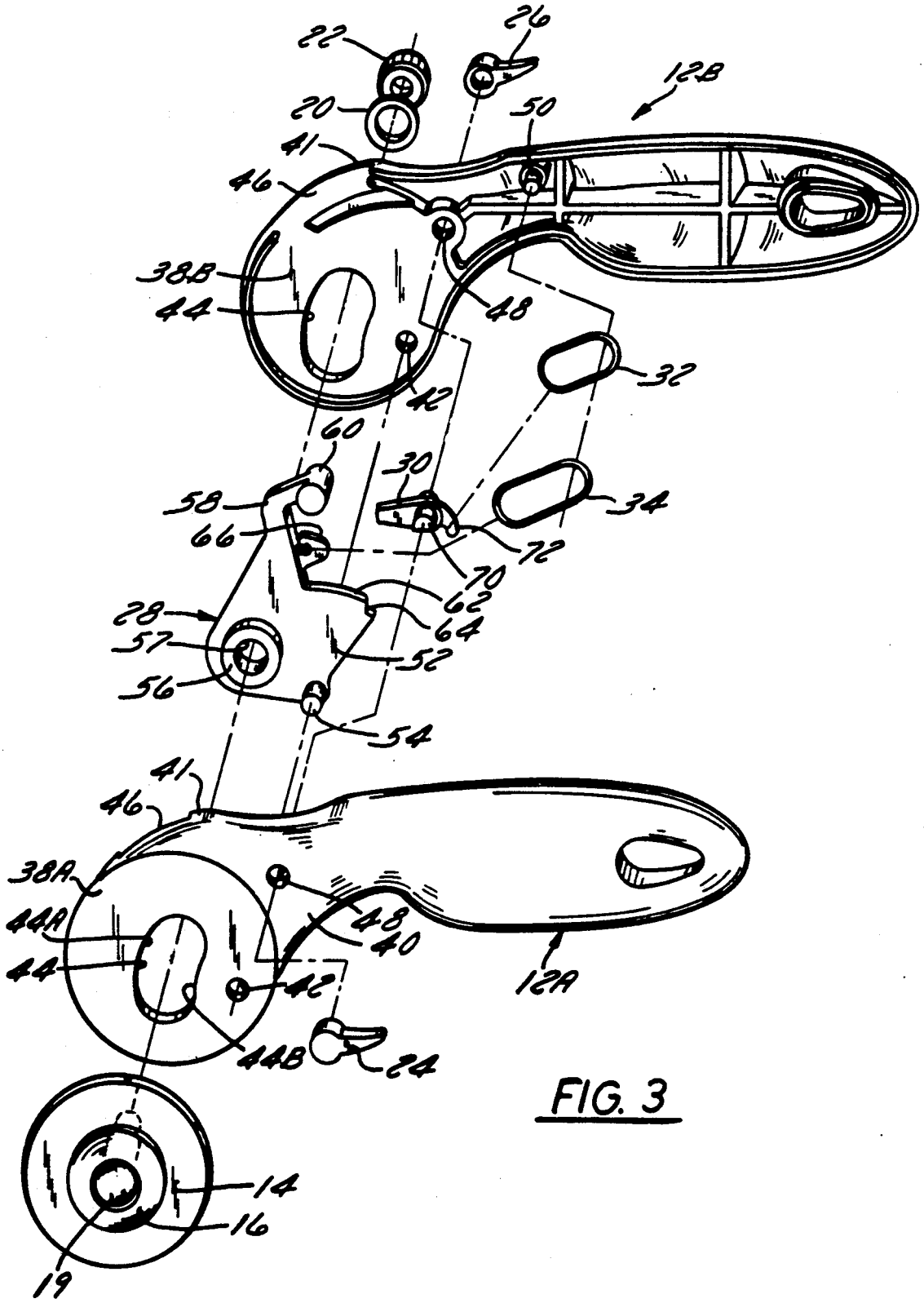
FIG. 3 is an exploded view of the rotary cutter.

Referring to FIGS. 1 and 2, a rotary cutter 10 in accordance with the present invention comprises a body 12, a disc-shaped blade 14 of predetermined diameter, a blade retainer 16, a retainer bolt 18, a spring washer 20, a retainer nut 22, and a lock lever 24. As best seen in FIG. 3, body 12 is formed of respective symmetrical side parts 12A and 12B which, in assembly, form an interior cavity therebetween. A pivoting member 28, a locking pawl 30, and respective elastic bands 32 and 34 are disposed within the body cavity.

Body 12 includes a handgrip portion 36 and a cylindrical head 38 interconnected by an integrally formed blending neck 40. As will be further described, handgrip 36 manifests a three dimensional configuration which not only comfortably fits either hand, but also, in cooperation with neck 40, permits the user to guide cutter 10 using either the thumb or forefinger, and optimizes downward and longitudinal (forward or rearward) force on blade 14 when in use.

Referring to FIGS. 1-3 and 7 the head 38 includes a planar disk or platform having substantially flat side surfaces 38A and 38B, manifesting a generally circular periphery. The side surfaces 38A and 38B are of a diameter greater than the diameter of blade 14, and each includes a transverse through bore 42 and an arcuate-shaped aperture 44 extending transversely therethrough (FIGS. 2, 3). The major arcs 44A and 44B of aperture 44 are concentric with bore 42.

Figure 7:
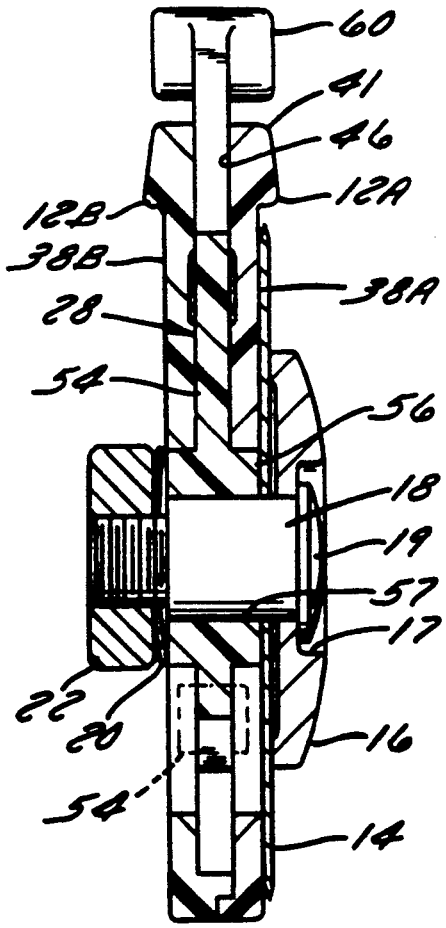
FIG. 7 is a cross sectional view taken on line 7—7 of FIG. 1.

Referring again to FIGS. 1 and 2, neck 40 provides a smooth, integral connection between handle portion 36 and head 38, and is contoured to receive a user's thumb or forefinger on the rear top surface thereof. Neck 40 includes a forward top transverse surface 41 comprising an arc concentric with bore 42, in which a longitudinally disposed slot 46 is formed. As best seen in FIGS. 3 and 7, respective apertures 48 are also formed in the sides of neck 40, rearwardly of bore 42 and slot 46. A pin 50 is formed on the interior of one or both of body side parts 12A and 12B. The relative disposition and dimensional relationships of the various components of body 12 will be described in more detail in conjunction with FIGS. 2 and 3.

Referring to FIG. 3, pivoting member 28 is pivotally mounted within the head 38 and includes: a generally planar body 52; a pivot pin 54 extending perpendicularly from each side of body 52; respective cylindrical bosses 56 symmetrically disposed on each side of body 52 and having an axial bore 57 extending therethrough; a stem 58 terminating in a thumb lever 60; a major cammed surface 62 terminating at a ledge 64; and a hook 66. In assembly, the ends of pin 54 are received in bores 42; bosses 56 are received in said arcuate-shaped apertures 44; and stem 58 extends through slot 46, with lever 60 disposed exteriorly of platform 38.

Blade 14 is rotatably secured to boss 56 of pivoting member 28. In assembly, the end surfaces of the bosses 56 are, as best seen in FIG. 2, substantially coplanar with the flat surfaces 38A and 38B of head 38. Blade 14 is disposed adjacent head 38, and blade retainer 16 adjacent to blade 14, with central apertures 14A and 16A in registry with boss bore 57. Retainer bolt 18 is journalled through blade retainer 16, blade 14, bosses 56, and spring washer 20 and is threadedly engaged by nut 22. The head 19 of retainer bolt 18 is suitably received within a counterbore 17 formed in retainer 16. A portion of the shaft of bolt 18 may be keyed, and bore 57 shaped accordingly, to prevent rotation of bolt 18 relative to pivoting member 28. With this arrangement the blade 14 and blade retainer 16 can be quickly and easily removed from the handle for cleaning and reassembling to maintain sanitary conditions.

Blade 14 is rotatable about the shaft of bolt 18. When nut 22 is fully engaged, spring washer 20 is compressed, causing retainer 16 to bear against blade 14 with a predetermined force so that a predetermined frictional resistance against rotation is effected.

Figure 4:
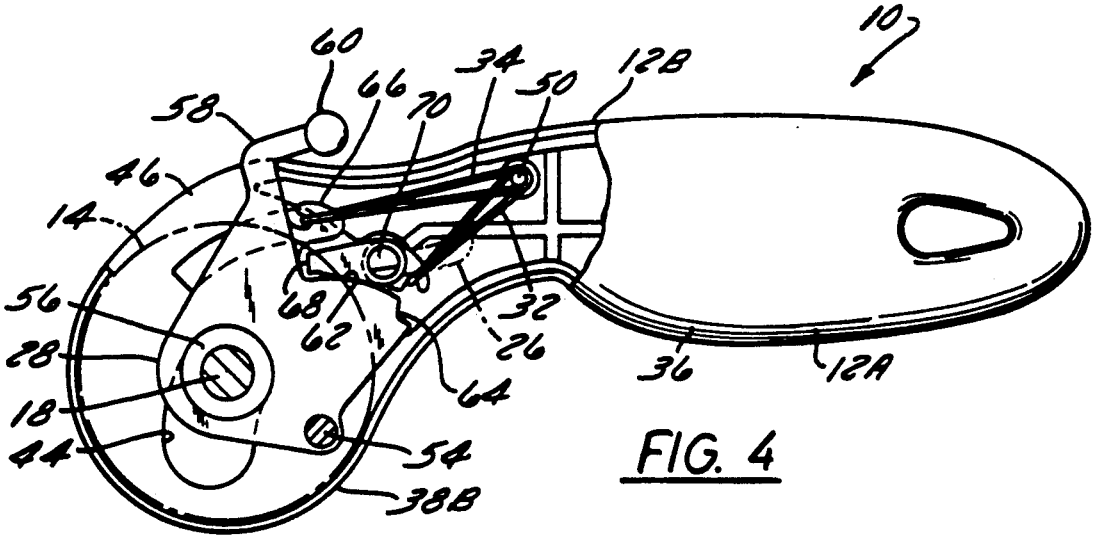
FIG. 4 is a side view of the rotary cutter with a portion broken away to show the pivoting assembly for the blade.
Figure 5:
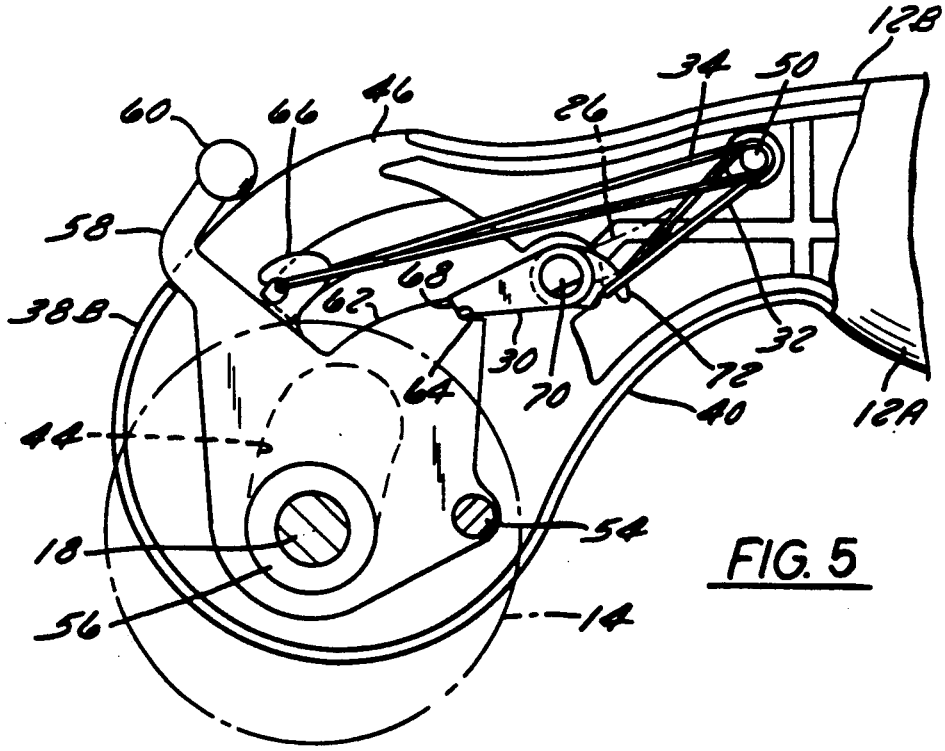
FIG. 5 is an enlarged view of the pivoting assembly.

Pivoting member 28 is employed to controllably move blade 14 relative to head 38 between cutting and retracted positions. Referring now to FIGS. 4 and 5, stem 58 may be made to travel the extent of slot 46, causing member 28 to pivot about pin 54, such that bosses 56 (and thus the axis of blade 14) travel through the arc defined by aperture 44. As shown in FIG. 4, when member 28 is in the rearmost (retracted) position, the edge of blade 14 is contained within the area of head 38. The blade is thus retracted. As shown in FIG. 5, when actuator lever 60 is pushed forward, to place stem 58 in the vicinity of the forward extremity of slot 46, member 28 rotates counter-clockwise into a forward (cutting) position, in which a portion of the periphery of blade 14 extends beyond the periphery of cylindrical head 38. Blade 14 is thus disposed in an exposed (cutting) position.

Figure 6:
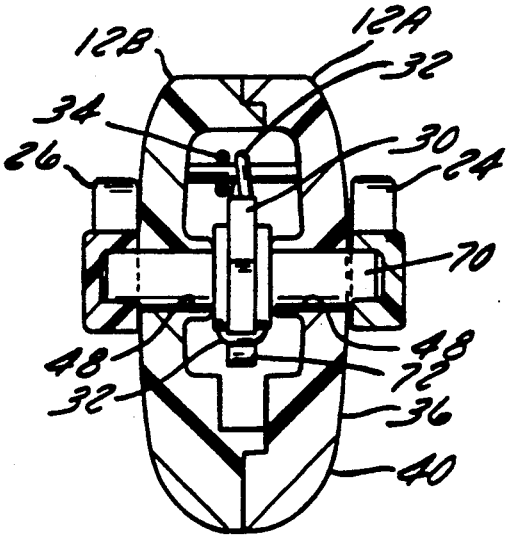
FIG. 6 is a cross sectional view taken on line 6—6 of FIG. 1.

Locking pawl 30, also pivotally mounted within handle 36, cooperates with lever 24 to selectively lock blade 14 in the cutting position. Referring now to FIGS. 3 and 6, locking pawl 30 includes a terminal portion 68, respective cylindrical posts 70 keyed for rotation with internal key bores in levers 24 and 26, and an end hook portion 72. Posts 70 are journalled through apertures 48 in body sides 12A and 12B, and are affixed to levers 24 and 26 such that terminal portion 68 is selectively pivoted about the axis defined by posts 70 in response to rotation of either lever 24 or lever 26. Elastic band 32 is fixed over hook portion 72 of actuator pawl 30, and extends over post 50 to provide a counter-clockwise rotational bias on locking pawl 30. Member 28, on the other hand, is biased for clockwise rotation by elastic band 34; elastic band 34 is fixed to hook 66 at one end, and at the other to post 50.

As shown in FIGS. 4 and 5, the relative dimensions and dispositions of member 28 and pawl 30 are such that pawl terminal portion 68 normally rides on cam surface 62 of member 28. When member 28 is rotated counter-clockwise (by forward movement of stem 58 within slot 46), cam surface 62 moves relative to pawl 30, and pawl terminal portion 68, under counter-clockwise rotational bias, ultimately drops off cam surface 62 at a step or ledge 64 (at a point corresponding to stem 58 being located at the forward extremity of slot 46 and bosses 56 at the lower extremity of arcuate-shaped aperture 44) (FIG. 5). The end of pawl 30 lodges against ledge 64 of member 28, locking member 28 in the forward position.

To release pivoting member 28 from the forward position, lever 24 or 26 is rotated in a clockwise direction in FIG. 1, causing pawl 30 to likewise rotate, and lift out of ledge 64. The bias from elastic band 34 causes clockwise rotation of member 28, again disposing cam surface 62 under pawl 30. Member 28 thus, under bias, resumes the retracted position.

As previously mentioned, handgrip 36 manifests a contoured configuration which fits either the right or left hand comfortably, and permits the user to guide cutter 10 using either a thumb or forefinger, while at the same time exerting the necessary downward and forward force on blade 14.

Thus, it should be apparent that there has been provided in accordance with the present invention an hand-held cutter having a rotatable circular blade and safety guard that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A rotary cutter comprising a handle, a cylindrical head formed on one end of said handle, said head having an internal cavity and a planar surface on each side thereof, an actuating member pivotally mounted in said cavity, a circular blade secured to one side of said actuating member in a parallel relation to one of said planar surfaces, means on the periphery of said head for moving said actuating member to an operative position with a portion of said blade projecting outwardly from said cylindrical head, and means in said cavity for biasing said actuating member to a storage position.

2. The rotary cutter according to claim 1 including means in said cavity for locking said actuating member in the operative position.

3. The rotary cutter according to claim 2 wherein said actuating member includes a step in the outer periphery thereof and said locking means comprises a pawl pivotally mounted in said cavity for movement into engagement with said step in said actuating member, and means for biasing said pawl into engagement with said step.

4. The rotary cutter according to claim 3 including means on either side of said handle for releasing said pawl from said step in said actuating member whereby said actuating member is biased to the storage position.

5. A rotary cutter comprising:

an elongate handle having a shape conforming to the palm of a person's hand, a blade mounting head having a circular platform on each side thereof, a contoured neck connecting said mounting head to said handle, an actuating member pivotally mounted in said mounting head, a curved opening in one of said platforms, a cutter blade pivotally connected to said actuating member through said curved opening, said blade being mounted in a parallel relation to the outside surface of said one of said platforms, and means on said actuating member for moving said actuating member to expose a portion of said rotary blade beyond the periphery of said head for cutting.

6. The cutter according to claim 5 wherein said actuating member includes a curved surface having a ledge at one end, and means in said handle for engaging said ledge to hold said blade in an operative position.

7. The cutter according to claim 5 including a circular boss on said actuating member aligned with said curved opening and having a support surface coplanar with said one of said platforms to minimize surface pressure between said blade and said platform.

8. A manually operated rotary cutting device comprising:

an elongated handle having a first end forming a gripping surface, and a second end disposed in a longitudinally spaced relation to said first end, said second end being provided with a platform, an actuating member pivotally mounted in said second end, a rotary cutter blade supported on said actuating member in a parallel relation with said platform, means mounted on said second end for moving said actuating member from a storage position with respect to said platform to a cutting position wherein a portion of said blade is moved radially outwardly of said platform, and means mounted in said second end for locking said actuating member in said cutting position.

9. The cutting device according to claim 8 including first means for biasing said actuating member to the storage position and second means for biasing said locking means to a locking position with respect to moving means.

10. The cutting device according to claim 9 including means mounted on the outside of said handle for moving said locking means away from said actuating member.

* * * * *